US009617782B2

(12) United States Patent
Gramstad

(10) Patent No.: US 9,617,782 B2
(45) Date of Patent: Apr. 11, 2017

(54) SELF-SEALING BUTT HINGE

(71) Applicant: Truth Hardware Corporation, Owatonna, MN (US)

(72) Inventor: Derek Ronald Gramstad, Owatonna, MN (US)

(73) Assignee: Truth Hardware Corporation, Owatonna, MN (US)

( * ) Notice: Subject to any disclaimer, the term of this patent is extended or adjusted under 35 U.S.C. 154(b) by 0 days.

(21) Appl. No.: 14/821,045

(22) Filed: Aug. 7, 2015

(65) Prior Publication Data

US 2016/0040463 A1 Feb. 11, 2016

Related U.S. Application Data

(60) Provisional application No. 62/034,379, filed on Aug. 7, 2014.

(51) Int. Cl.

| | |
|---|---|
| ***E06B 7/16*** | (2006.01) |
| ***E05D 3/02*** | (2006.01) |
| ***E05D 5/04*** | (2006.01) |
| ***E05D 5/12*** | (2006.01) |
| ***E05D 11/00*** | (2006.01) |

(52) U.S. Cl.

CPC ..... *E06B 7/16* (2013.01); *E05D 3/02* (2013.01); *E05D 5/04* (2013.01); *E05D 5/128* (2013.01); *E05D 11/0054* (2013.01); *E05D 2011/0063* (2013.01); *E05Y 2800/12* (2013.01); *E05Y 2900/132* (2013.01); *E05Y 2900/148* (2013.01); *Y10T 16/558* (2015.01)

(58) Field of Classification Search

CPC ..... E06B 7/16; E05D 5/128; E05D 11/0054; E05D 5/04; E05D 3/02; E05D 2011/0063; E05D 7/0009; E05D 7/04; E05D 7/0045; E05D 2007/0484; E05Y 2900/132; E05Y 2900/148; E05Y 2800/12; Y10T 16/558; Y10T 16/532; Y10T 16/5326; Y10T 16/5327; Y10T 16/533; Y10T 16/5335; Y10T 16/554

USPC ..... 16/387, 235, 247, 248, 250, 251, 382; 49/475.1, 368

See application file for complete search history.

(56) References Cited

U.S. PATENT DOCUMENTS

| | | | |
|---|---|---|---|
| 442,547 | A | 12/1890 | Radler |
| 1,103,607 | A | 7/1914 | Moore |

(Continued)

*Primary Examiner* — William Miller

(74) *Attorney, Agent, or Firm* — Patterson Thuente Pedersen, P.A.

(57) ABSTRACT

A hinge for coupling a movable element to a frame that defines an opening that receives the movable element. The hinge includes a frame interface assembly adapted to attach to the frame at one or more attachment points. The frame interface assembly includes a frame leaf and a sealing member, the frame leaf defines a mounting face adapted to abut an exterior surface of the frame and a plurality of spaced apart knuckles. The sealing member defines an attachment point liquid barrier sealing face abutting an interior surface of the frame opposite the mounting face. The hinge further includes a sash leaf adapted to attach to the window sash, with the sash leaf defining one or more knuckles, and a pin assembly including a hinge pin extending through the knuckles of the frame leaf and the knuckles of the sash leaf to couple the frame leaf and the sash leaf.

23 Claims, 18 Drawing Sheets

(56) References Cited

U.S. PATENT DOCUMENTS 2,306,024 A * 12/1942 Parsons ..... E05D 3/02 16/221
2,373,955 A 4/1945 Fuller
2,504,635 A * 4/1950 Bradley ..... E05D 11/00 16/223
2,588,258 A 3/1952 Lowman
2,597,174 A * 5/1952 Patton ..... E05D 3/02 16/221
3,075,234 A * 1/1963 Speakman ..... B64C 1/1407 16/250
3,102,307 A * 9/1963 Johnson ..... E05C 19/024 16/389
3,216,053 A * 11/1965 Felix ..... E05D 5/10 16/247
3,921,225 A 11/1975 Suska
4,542,558 A 9/1985 Brockhaus
4,709,121 A * 11/1987 Shores ..... E05D 7/009 16/250
5,144,721 A 9/1992 Schade
5,339,493 A 8/1994 MacIntyre
5,425,157 A 6/1995 Chang
5,694,665 A 12/1997 Strickland et al.
5,701,636 A 12/1997 Jahnke
5,713,105 A 2/1998 Toomey
5,755,011 A 5/1998 Green et al.
5,943,739 A * 8/1999 Vandergriff ..... E05D 3/12 16/221
6,212,734 B1 4/2001 Commons
6,216,316 B1 4/2001 Errichiello
6,484,363 B1 11/2002 Chung
6,715,181 B1 4/2004 Fries
6,757,938 B1 7/2004 di Vinadio
6,895,636 B2 * 5/2005 Nussbaum ..... E05D 5/0238 16/241
7,162,774 B1 1/2007 Von Resch et al.
7,240,400 B2 7/2007 Bonham
7,293,329 B2 11/2007 Heid
7,331,085 B2 2/2008 Heid
7,334,293 B2 2/2008 Erickson et al.
7,346,959 B2 3/2008 Heid
7,552,511 B2 6/2009 Campbell et al.
7,571,516 B2 8/2009 Lueffe et al.
7,587,788 B2 9/2009 Heid
7,603,746 B1 10/2009 von Resch et al.
8,464,396 B2 * 6/2013 Westby ..... E05D 5/12 16/380
8,490,246 B2 7/2013 Waddell
2008/0104799 A1 5/2008 Hoppe et al.
2014/0047673 A1 2/2014 Waddell

* cited by examiner

SELF-SEALING BUTT HINGE

RELATED APPLICATION

The present application claims the benefit of U.S. Provisional Application No. 62/034,379 filed Aug. 7, 2014, said application being hereby incorporated herein in its entirety by reference.

TECHNICAL FIELD

The present application relates generally to hinges for doors and windows, and more specially to butt hinges for swinging doors and windows.

BACKGROUND

Swinging door and window assemblies are well known in the art. Swinging door and window assemblies commonly employ one or more door or butt hinges used to pivot the door or window when opening or closing the door or window. Conventional door or butt hinges are composed of two leaves pivotably coupled to one another by a pivot pin and interlocking sleeve, knuckle, or pintle. One leaf is fixedly coupled to the door edge or window sash, while the other leaf is fixedly coupled to the door or window frame. A drawback to existing door or butt hinges, however, is that they typically require additional sealing to prevent water from seeping through the attachment points and infiltrating the frame after installation.

What is needed in the industry is a butt hinge for windows and doors that is self-sealing to reduce or prevent infiltration of water into the frame after installation.

SUMMARY OF THE DISCLOSURE

Embodiments of the present disclosure meet the need of the industry for a door or butt hinge that is self-sealing to reduce or prevent infiltration of water into a window or door frame after installation.

An embodiment of the present invention is a hinge for coupling a window to a window frame. The hinge includes a frame interface assembly, a sash leaf, and a pin assembly. The frame interface assembly is adapted to attach to the window frame. In an embodiment, the frame interface assembly is adapted to attach to the window frame at one or more attachment points, and includes a frame leaf and a sealing member. The frame leaf defines a mounting face adapted to attach to an exterior of the window frame and a plurality of spaced apart knuckles. The sealing member defines an attachment point liquid barrier sealing face adapted to attach to an interior of the window frame opposite the mounting face. In an embodiment, the sash leaf can be adapted to attach to the window sash, and defines one or more knuckles. A pin assembly includes a hinge pin extending through the plurality of spaced apart knuckles of the frame leaf and the one or more knuckles of the sash leaf to operably couple the frame leaf and the sash leaf.

In another embodiment, the hinge couples a door to a door frame. In such an embodiment, the sash leaf can alternatively be referred to as a door panel leaf. The structure of the hinge is otherwise consistent with the hinge described above, and the various embodiments of the self-sealing hinge described in this disclosure.

One function of the self-sealing hinge is to reduce or prevent liquid, such as water, from entering the interior of the frame through the attachment points, when the self-sealing hinge is attached to the frame. The hinge is self-sealing and eliminates the need to apply additional silicone sealant during installation, thereby increasing the reliability of weather proofing and improving the efficiency of installation of the self-sealing hinge to an existing frame or the manufacture of windows and doors employing the self-sealing hinges. In addition to the aforementioned benefits, a sealing member can also be employed to reduce the thickness of the frame at the hinge attachment points. A reduction in the thickness of the frame can reduce the weight, required materials for construction, and cost of windows and doors employing the self-sealing hinge.

According to an embodiment of the invention, a hinge for coupling a movable element to a frame that receives the movable element includes a frame interface assembly adapted to attach to the frame at one or more attachment points. The frame interface assembly includes a first leaf and a sealing member, the first leaf defining a mounting face adapted to abut an exterior surface of the frame and a plurality of spaced apart knuckles, the sealing member defining an attachment point liquid barrier sealing face adapted to abut an interior surface of the frame opposite the mounting face. The hinge further includes a second leaf adapted to attach to the moveable element, with the second leaf defining one or more knuckles, and a pin assembly including a hinge pin extending through the spaced apart knuckles of the first leaf and the one or more knuckles of the second leaf to operably couple the first leaf and the second leaf. In embodiments of the invention the sealing member may be made from metal or a resilient material such as plastic or rubber. In further embodiments, the sealing member may include a gasket made from silicone or rubber material. The sealing member may include an installation tab, which may be detachable from the sealing member.

In further embodiments, a hinge for coupling a window sash to a window frame includes a frame interface assembly adapted to attach to the window frame at one or more attachment points. The frame interface assembly includes a frame leaf and a sealing member, with the frame leaf defining a mounting face adapted to abut an exterior surface of the window frame and a plurality of spaced apart knuckles. The sealing member defines an attachment point liquid barrier sealing face adapted to abut an interior of the window frame opposite the mounting face. A sash leaf is adapted to attach to the window sash, the sash leaf defining one or more knuckles. The hinge further includes a pin assembly including a hinge pin extending through the spaced apart knuckles of the frame leaf and the one or more knuckles of the sash leaf to operably couple the frame leaf and the sash leaf. In embodiments of the invention the sealing member may be made from metal or a resilient material such as plastic or rubber. In further embodiments, the sealing member may include a gasket made from silicone or rubber material. The sealing member may include an installation tab, which may be detachable from the sealing member.

In further embodiments, a hinge for coupling a door panel to a door frame includes a frame interface assembly adapted to attach to the door frame at one or more attachment points. The frame interface assembly includes a frame leaf and a sealing member, with the frame leaf defining a mounting face adapted to abut an exterior surface of the door frame and a plurality of spaced apart knuckles. The sealing member defines an attachment point liquid barrier sealing face adapted to abut an interior of the door frame opposite the mounting face. A door panel leaf is adapted to attach to the door panel, the door panel leaf defining one or more knuckles. The hinge further includes a pin assembly including a hinge pin extending through the spaced apart knuckles of the frame leaf and the one or more knuckles of the door panel leaf to operably couple the frame leaf and the door panel leaf. In embodiments of the invention the sealing member may be made from metal or a resilient material such as plastic or rubber. In further embodiments, the sealing member may include a gasket made from silicone or rubber material. The sealing member may include an installation tab, which may be detachable from the sealing member.

In embodiments of the invention, an assembly for creating an opening in the exterior envelope of a structure includes a movable element operably coupled to a frame with a hinge. The frame defines an opening that receives the movable element. The hinge includes a frame interface assembly adapted to attach to the frame at one or more attachment points. The frame interface assembly includes a first leaf and a sealing member, with the first leaf defining a mounting face adapted to abut an exterior surface of the frame and a plurality of spaced apart knuckles. The sealing member defines an attachment point liquid barrier sealing face adapted to abut an interior surface of the frame opposite the mounting face. The hinge further includes a second leaf adapted to attach to the movable element, the second leaf defining one or more knuckles, and a pin assembly including a hinge pin extending through the spaced apart knuckles of the first leaf and the one or more knuckles of the second leaf to operably couple the first leaf and the second leaf. The moveable element may be a door panel or a window sash.

The summary above is not intended to describe each illustrated embodiment or every implementation of the present disclosure. The figures and the detailed description that follow more particularly exemplify these embodiments.

BRIEF DESCRIPTION OF THE DRAWINGS

The disclosure can be more completely understood in consideration of the following detailed description of various embodiments of the disclosure, in connection with the accompanying drawings, in which:

FIG. 14 is an isometric view of a sash leaf mounted to a sash in accordance with an embodiment of the disclosure;

FIGS. 15-16 are isometric views of a self-sealing hinge including a cover plate in accordance with an embodiment of the disclosure;

Figure 1:
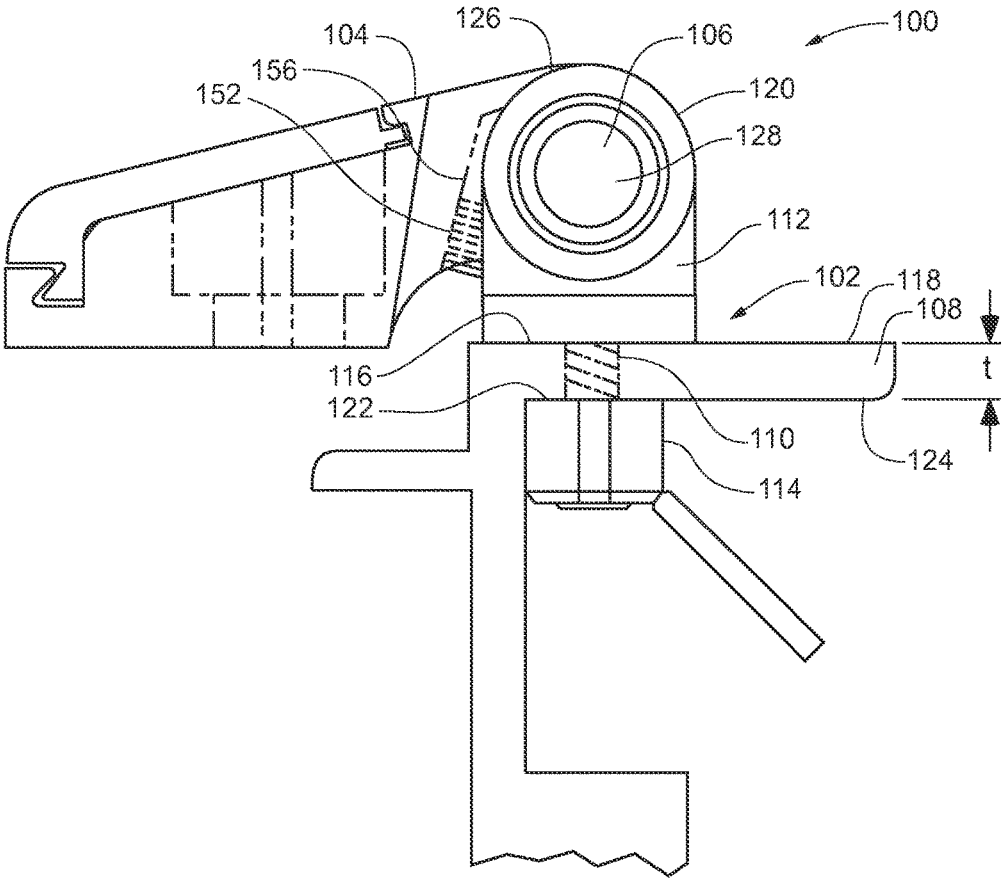
FIG. 1 is a side view of a self-sealing hinge coupled to a frame in accordance with an embodiment of the disclosure.

While the disclosure is amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure as defined by the appended claims.

DETAILED DESCRIPTION

Figure 18:
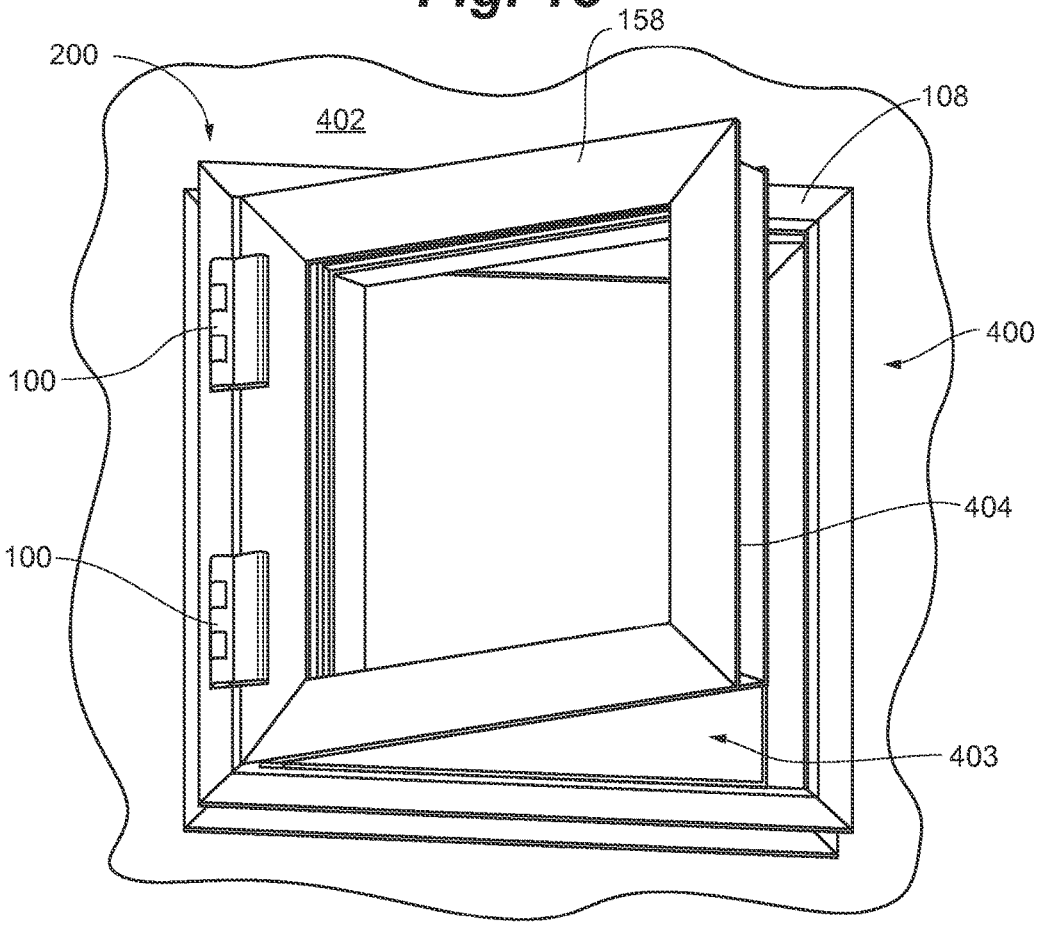

Referring to FIG. 18, an assembly 400 for creating an opening in the exterior envelope 402 of a building is depicted. Assembly 400 generally includes frame 108 defining opening 403 and moveable element 404 to selectively close opening 403. Exterior envelope 402 can be a wall or roof of a building. In FIG. 18, the assembly 400 is a window, and movable element 404 is a sash 158, but in other embodiments, assembly 400 can be a door or skylight.

Figure 2:
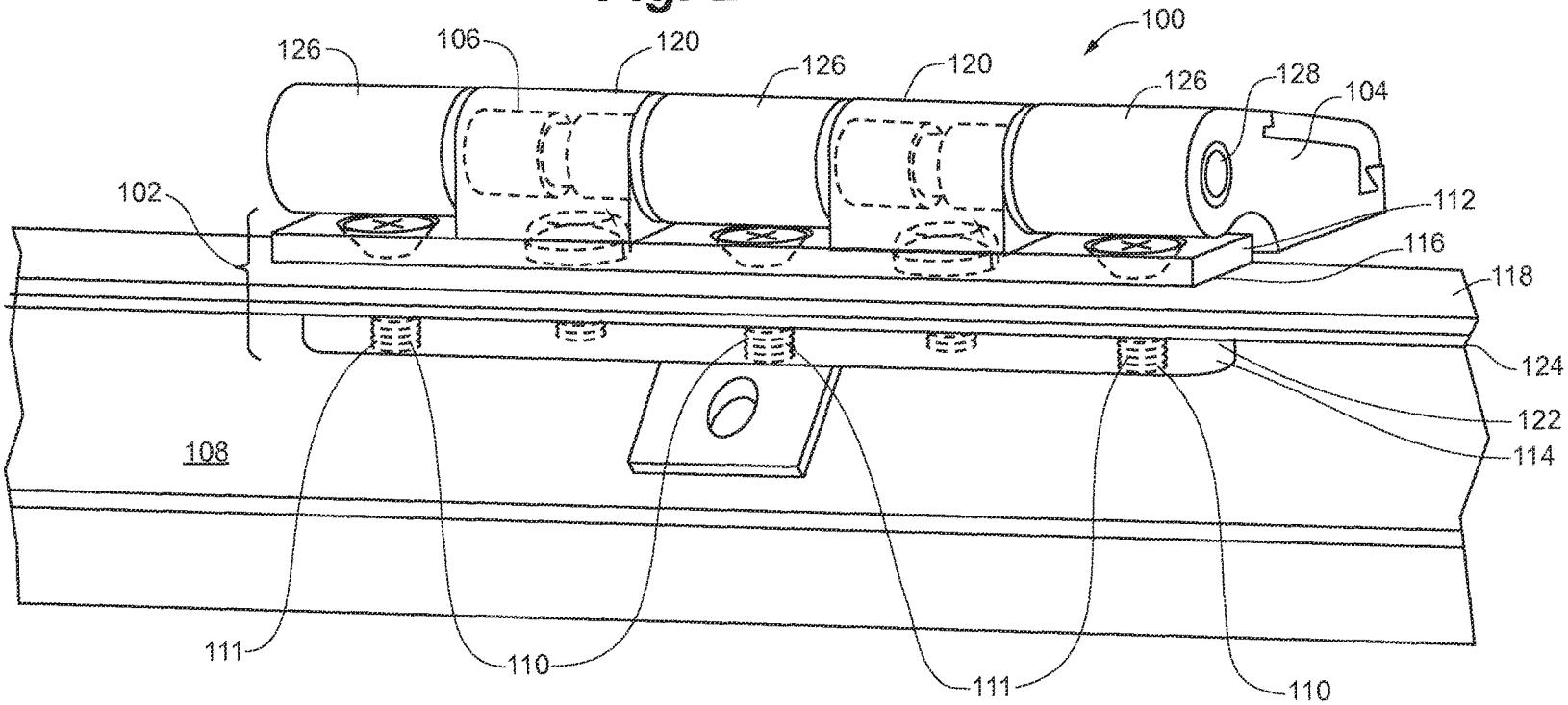
FIG. 2 is an isometric view of the self-sealing hinge of FIG. 1.

Referring to FIGS. 1 and 2, a self-sealing hinge 100 according to a disclosed embodiment is depicted. Self-sealing hinge 100 generally includes a frame interface assembly 102, a sash leaf 104, and a pin assembly 106. Self-sealing hinge 100 can be adapted to attach to a frame 108 of a window or door.

In one embodiment, frame interface assembly 102 attaches to frame 108 at one or more attachment points 110, and includes a first or frame leaf 112 and sealing member 114. Frame leaf 112 defines a mounting face 116 adapted to attach to the exterior of the frame 118. Frame leaf 112 also defines a plurality of spaced apart knuckles 120. Sealing member 114 defines attachment point liquid barrier sealing face 122 adapted to attach to the interior of frame 124, opposite mounting face 116. In one embodiment, a second or sash leaf 104 defines one or more knuckles 126. Pin assembly 106 includes hinge pin 128 extending through the plurality of spaced apart knuckles 120 and the one or more knuckles 126 to pivotably couple the frame leaf 112 to the sash leaf 104.

A function of self-sealing hinge 100 is to reduce or prevent liquid, such as water, from entering the interior of frame 108 through attachment points 110, when self-sealing hinge 100 is attached to frame 108. Self-sealing hinge 100 is self-sealing and eliminates the need to apply additional silicone during installation, thereby increasing the reliability of weather proofing and improving the efficiency of installation of self-sealing hinge 100 to existing frame 108 or the manufacture of windows and doors employing self-sealing hinges 100.

In addition to the aforementioned benefits, sealing member 114 can also be employed to reduce the thickness (t) of frame 108 at hinge attachment points 110. In hinges of the prior art, the portion of hinge 100 that attaches to frame 108, attaches only to frame 100. By contrast, in an embodiment of the present disclosure, frame 108 is sandwiched between frame leaf 112 and sealing member 114. Accordingly, the profile thickness (t) of frame 108 can be thinner than the prior art, as the frame 108 need not be the sole structure for retaining fasteners 111 at attachment points 110. A reduction in the thickness (t) of frame 108 can reduce the weight, required materials for construction of frame 108, and cost of windows and doors employing self-sealing hinge 100.

Figure 3A:
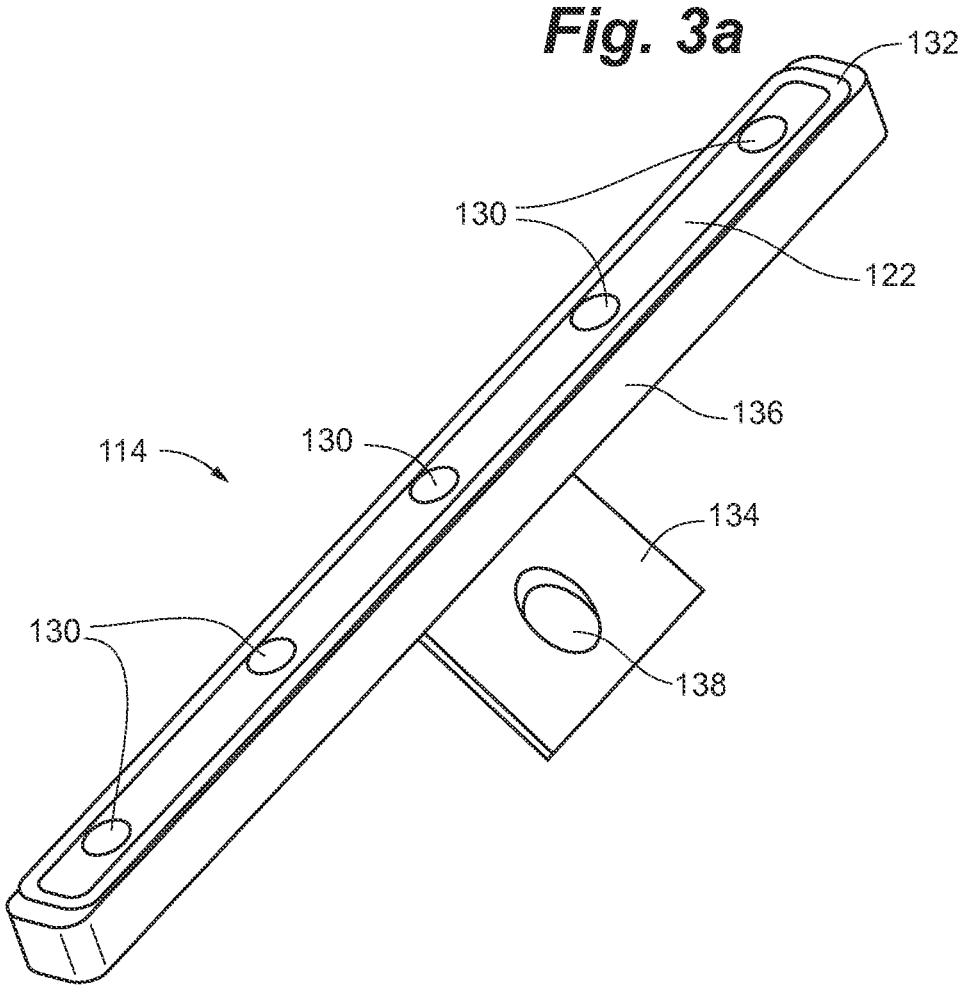
FIGS. 3*a*-3*c* are isometric views of sealing members in accordance with an embodiment of the disclosure.

Referring to FIG. 3*a*, sealing member 114 according to a disclosed embodiment is depicted. In one embodiment, sealing member 114 can be constructed out of a lightweight metal, for example aluminum. In another embodiment, sealing member 114 can be constructed out of plastic or rubber. Sealing member 114 can be any shape or size, provided that the attachment point liquid barrier sealing face 122 is positioned proximate attachment points 110, when sealing hinge 110 is attached to frame 108. The surface area of attachment point liquid barrier sealing face 122 can be smaller, larger, or approximately the same size as mounting face 116 of frame leaf 112. In one embodiment, sealing member 114 can include a plurality of indentations 130. In one embodiment, there can be a total of five indentations 130. Indentations 130 can be through-bore holes, blind-bore holes, tapped holes, or untapped indentations.

Figure 3B:
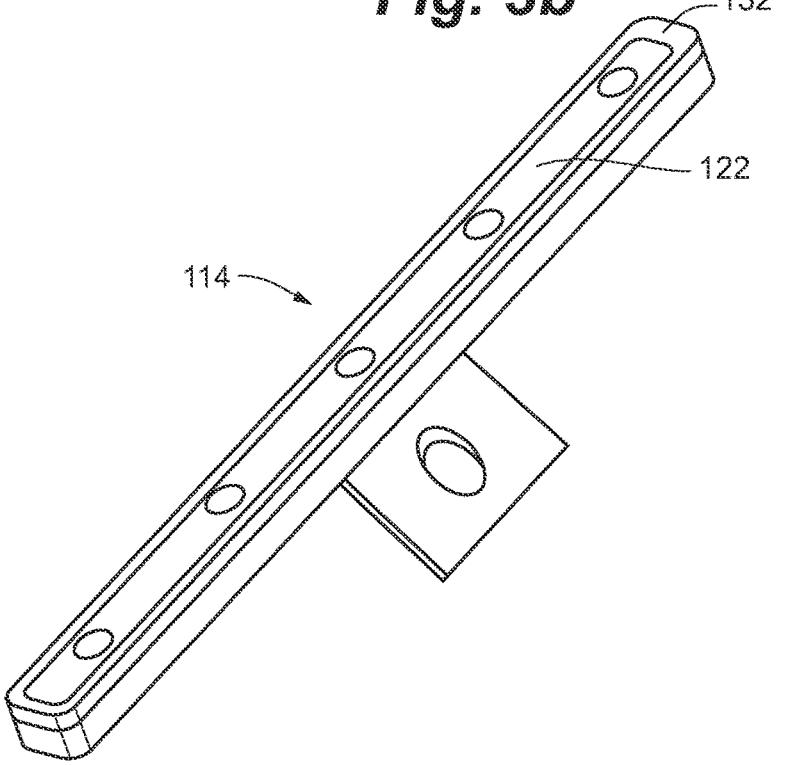
Figure 3C:
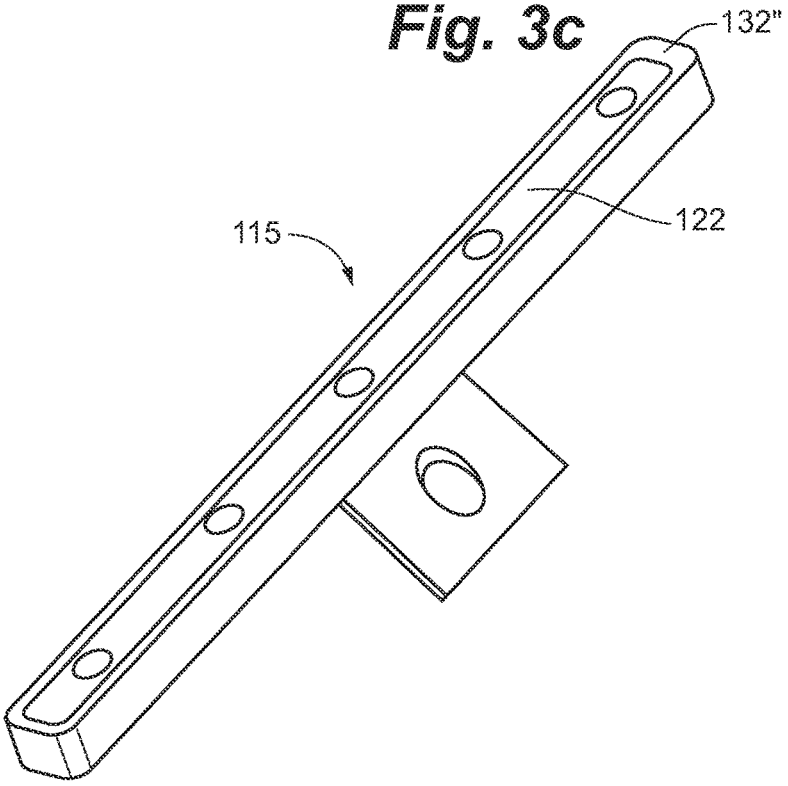

In one embodiment, sealing member 114 can include gasket 132. Gasket 132 is constructed of a rubber or silicone material. Gasket 132 is configured to surround the plurality of indentations 130. In one embodiment, gasket 132' (FIG. 3*b*) is configured as a layer on the attachment point liquid barrier sealing face 122. In another embodiment, gasket 132" (FIG. 3*c*) is integral to and formed as part of sealing member 114. The function of gasket 132 is to reduce or prevent liquid, such as water, from entering the interior of frame 108 through the attachment points 110, when self-sealing hinge 100 is attached to frame 108.

In one embodiment, sealing member 114 includes installation tab 134. Tab 134 may be used when attaching sealing member 114 to frame 108. The function of tab 134 is to assist in the location and positioning of sealing member 114 during installation. Once sealing member 114 is attached to frame 108, tab 134 can be removed. For example, tab 134 can be coupled to the main body 136 of sealing member 114 by a perforated or weakened joint or connection point that can readily break or tear upon a twisting, bending, shear or tensile force, thereby separating tab 134 from main body 136. In one embodiment, tab 134 includes an aperture 138 to assist in the location, positioning, installation, or removal of tab 134.

Figure 4:
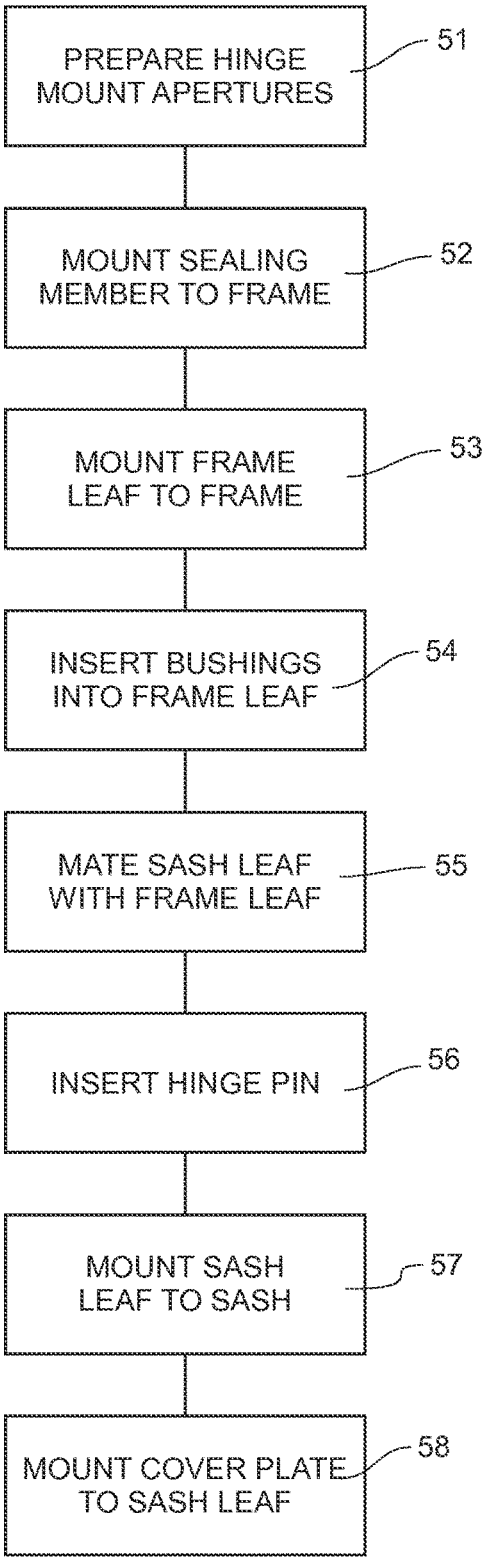
FIG. 4 is a flow chart depicting a method for installing a self-sealing hinge in accordance with one method of the disclosure.

Referring to FIG. 4, one method for installing the self-sealing hinge according the disclosure includes: at step S1, preparing a plurality of apertures 138 in frame 108; at step S2, mounting sealing member 114 to frame 108; at step S3 mounting frame leaf 112 to frame 108; at step S4 inserting bushings 142 into frame leaf 112; at step S5 mating sash leaf 104 with frame leaf 112; at step S6 inserting hinge pin 128; at step S7 mounting sash leaf 104 to sash 158; and at step S8 mounting cover plate 164 to sash leaf 104. The present disclosure, however, is not restricted to performing methods for installing self-sealing hinge according to any particular order.

Figure 5:
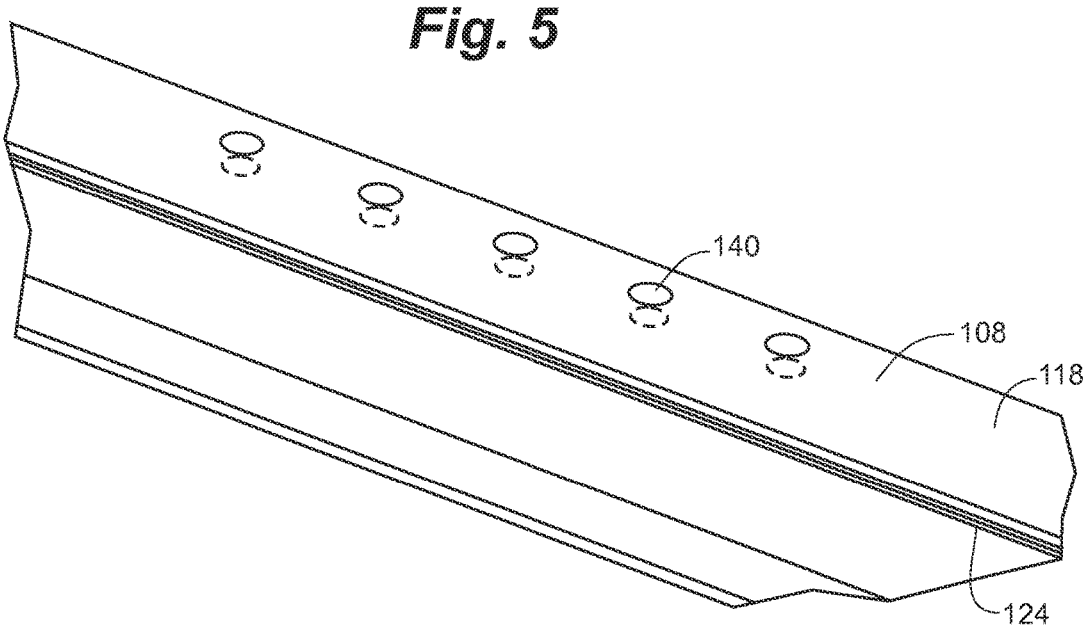
FIG. 5 is an isometric view of a frame with hinge mount apertures in accordance with an embodiment of the disclosure.

Referring to FIGS. 4 and 5, at step S1 a plurality of hinge mount apertures 140 are prepared on frame 108. In one embodiment, apertures 140 are through-bored holes that pass from the exterior of the frame 118 to the interior of the frame 124. In other embodiments, apertures 140 are blind-bore or tapped holes. In one embodiment, there can be five apertures 140. Additionally, one of skill in the art will recognize that in some cases a plurality of apertures 140 can pre-exist on frame 108, for example, frame 108 could be prefabricated with apertures 104, or self-sealing hinges 100 could replace prior art hinges on an existing door or window frame 108.

Figure 6:
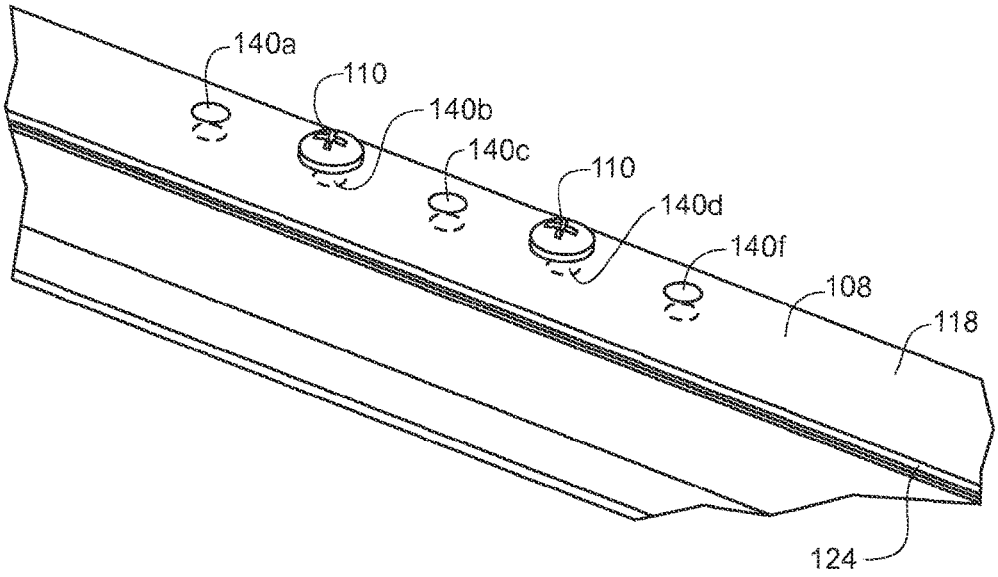
FIGS. 6-7 are isometric views of a sealing member mounted to a frame in accordance with an embodiment of the disclosure.
Figure 7:
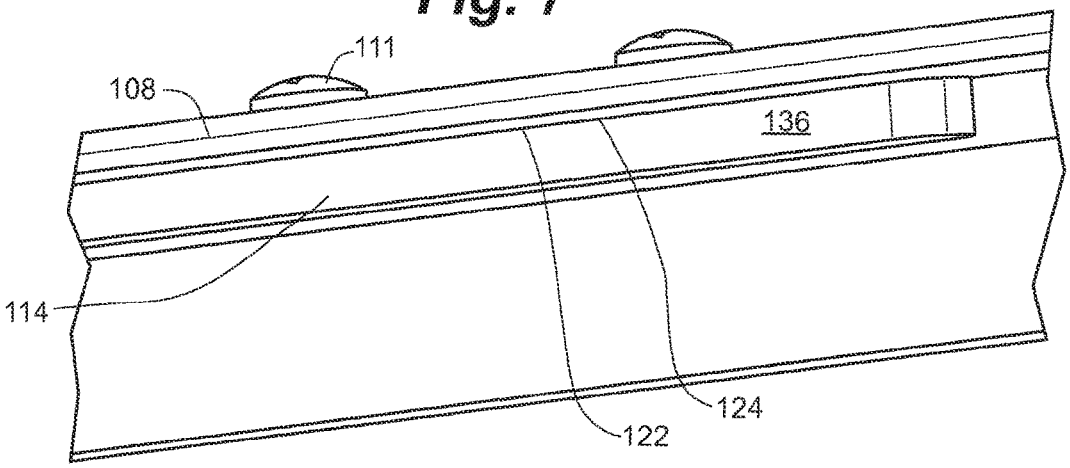

Referring to FIGS. 4 and 6-7, at step S2 sealing member 114 is mounted to the interior of the frame 124. In one embodiment, sealing member 114 is mounted to frame 108 via fasteners 111. In one embodiment, fasteners 111 are screws. In other embodiments, fasteners 111 may be bolts, rivets, pins, nails, or the like. Sealing member 114 is mounted so that attachment point liquid barrier sealing face 122 is aligned with apertures 140 on the interior of the frame 124. In one embodiment, two fasteners 111 are used to fixedly couple or secure sealing member 114 to frame 108. In one embodiment, the fasteners 111 pass through the second 140*b* and fourth 104*d* apertures. Each fastener 111 passes through aperture 140 and into the main body 136 of sealing member 114. In some embodiments, as depicted in FIG. 2, the ends of fasteners 111 are within main body 136 of sealing member 114 and do not protrude entirely through sealing member 114.

Figure 8:
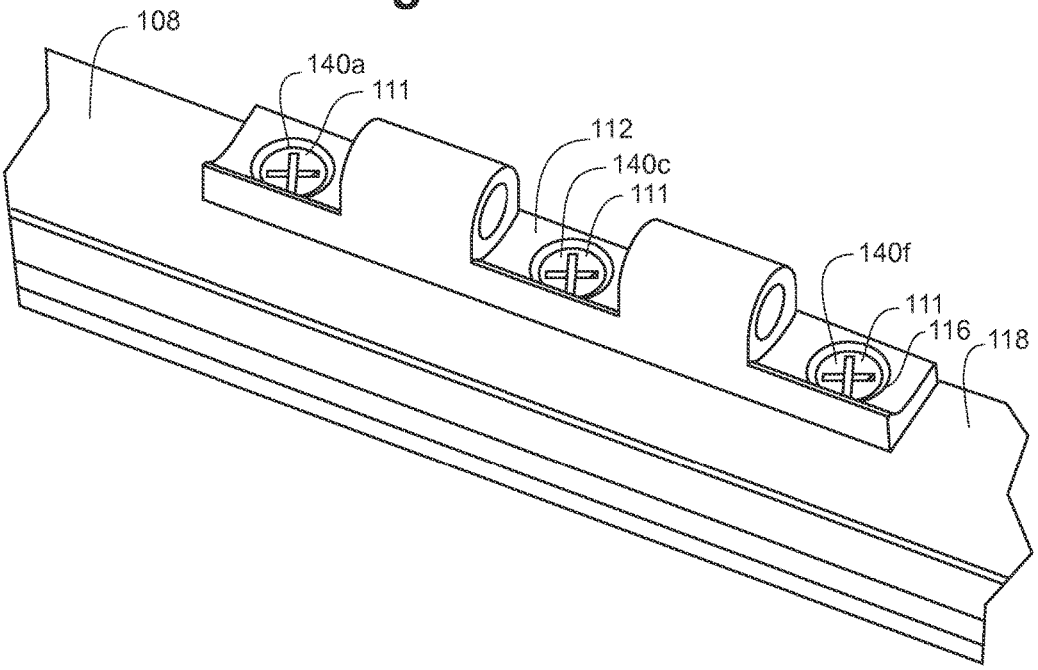
FIG. 8 is an isometric view of a frame leaf mounted to a frame in accordance with an embodiment of the disclosure.

Referring to FIGS. 4 and 8, at step S3 frame leaf 112 is mounted to the exterior of frame 118. In one embodiment, frame leaf 112 is mounted to frame 108 via fasteners. In one embodiment, fasteners 111 are screws. In other embodiments, fasteners 111 can be bolts, rivets, pins, nails, or the like. Frame leaf 112 is mounted so that mounting face 116 is adjacent frame exterior 118. In one embodiment, three fasteners 111 are used to fixedly couple or secure frame leaf 112 to frame 108. In one embodiment, the fasteners 111 pass through the first 140*a*third 140*c* and fifth 104*f* apertures. Each fastener 111 passes through frame leaf 112, through aperture 140 and into the main body 136 of sealing member 114. In some embodiments as depicted in FIG. 2, the ends of fasteners 111 are within main body 136 of sealing member 114 and do not protrude entirely through sealing member 114.

Figure 9:
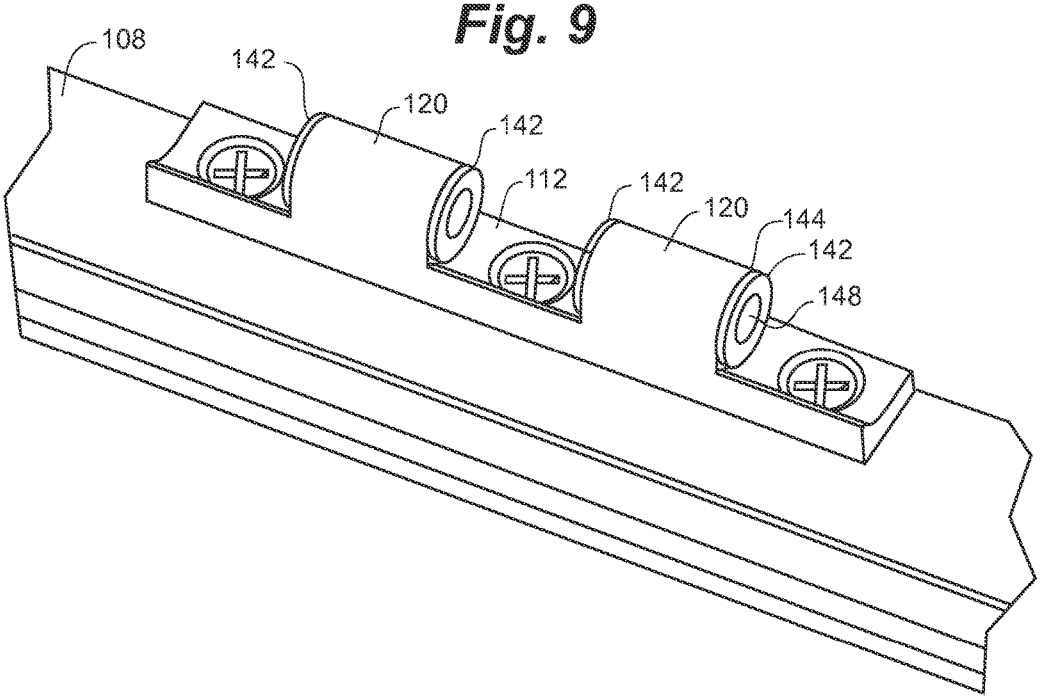
FIG. 9 is an isometric view of a frame leaf with bushings in accordance with an embodiment of the disclosure.

Referring to FIGS. 4 and 9, at step S4 one or more bushings 142 is inserted into knuckles 120 of frame leaf 112. In one embodiment, each knuckle 120 defines bore 144. Bore 144 can be sized to accommodate hinge pin 128 or a bushing 142. In one embodiment, bushing 142 is sized to fit within bore 144. Bushing 142 defines bore 146, sized to accommodate hinge pin 128. In one embodiment, bushing 142 is constructed of plastic. In another embodiment, bushing 142 is metal, ceramic, plastic, or a combination thereof. Knuckles 120 can be affixed in place with an adhesive or can be friction fit into bore 144. In one embodiment one or more of the knuckles 120 defines a bore 144 sized to directly accommodate hinge pin 128, with no bushing 142 required.

Figure 10:
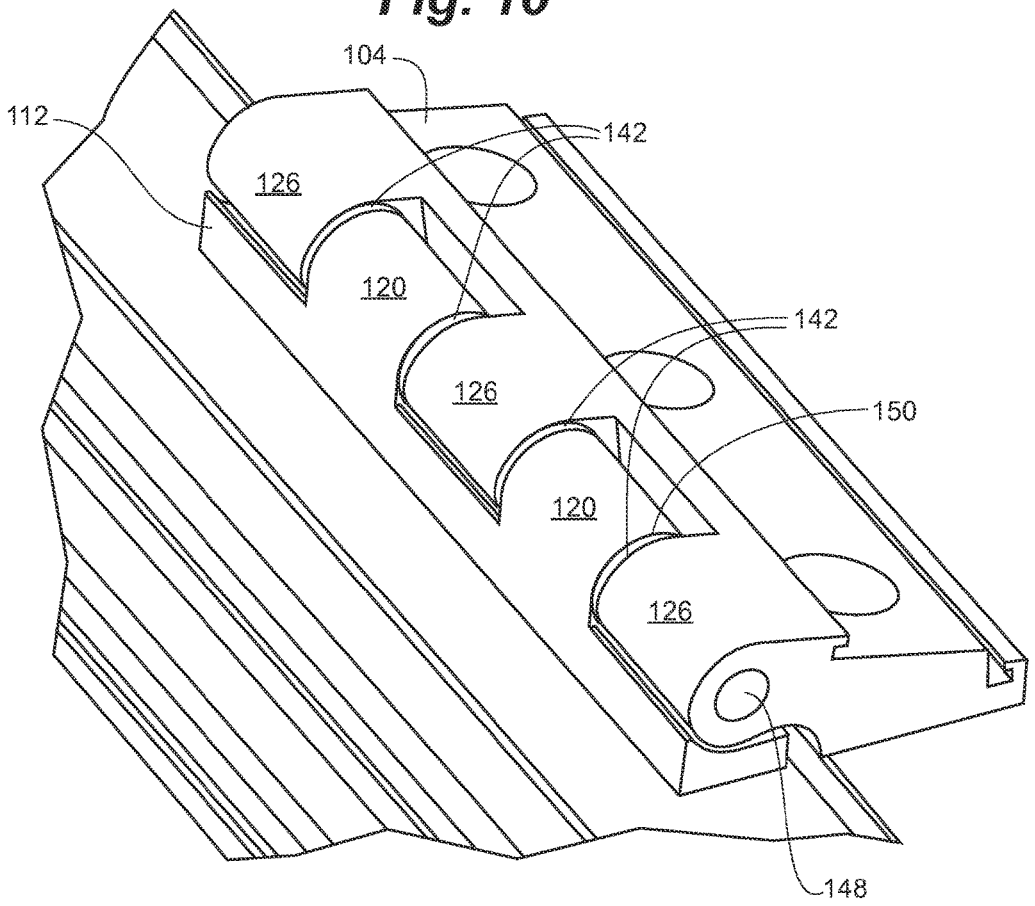
FIG. 10 is an isometric view of a mated sash leaf and frame leaf in accordance with an embodiment of the disclosure.

Referring to FIGS. 4 and 10, at step S5 sash leaf 104 is mated with frame leaf 112. In one embodiment, the plurality of spaced apart knuckles 120 of frame leaf 112 is meshed with the one or more knuckles 126 of sash leaf 104. In one embodiment, the one or more knuckles 126 defines bore 148. Bore 148 is sized to accommodate hinge pin 128 or a bushing. In one embodiment, bushing 142 includes a flange 150 that acts as a spacer separating knuckle 120 and knuckle 126.

Figure 11:
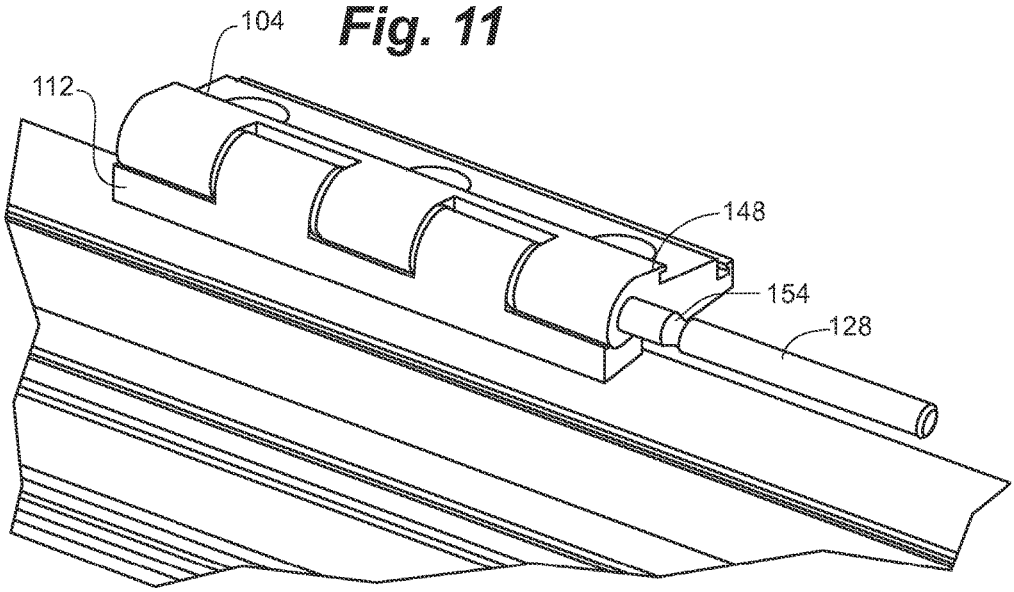
FIGS. 11-12 are isometric views of a hinge pin with a sash leaf and a frame leaf in accordance with an embodiment of the disclosure.
Figure 12:
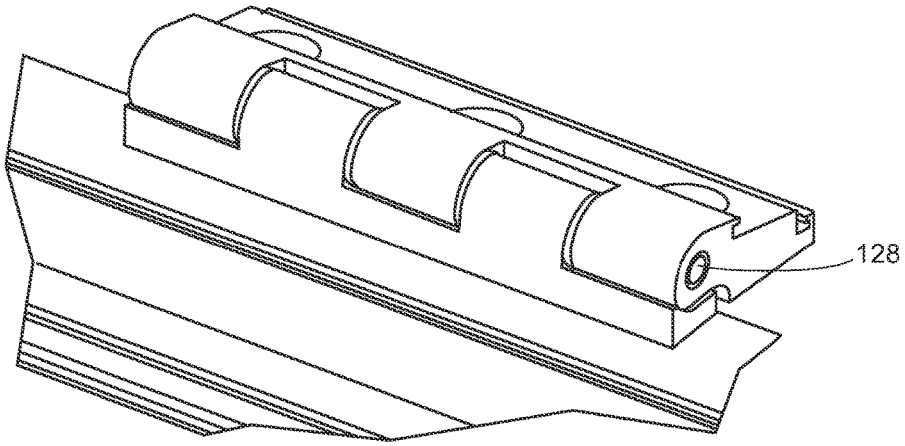
Figure 13:
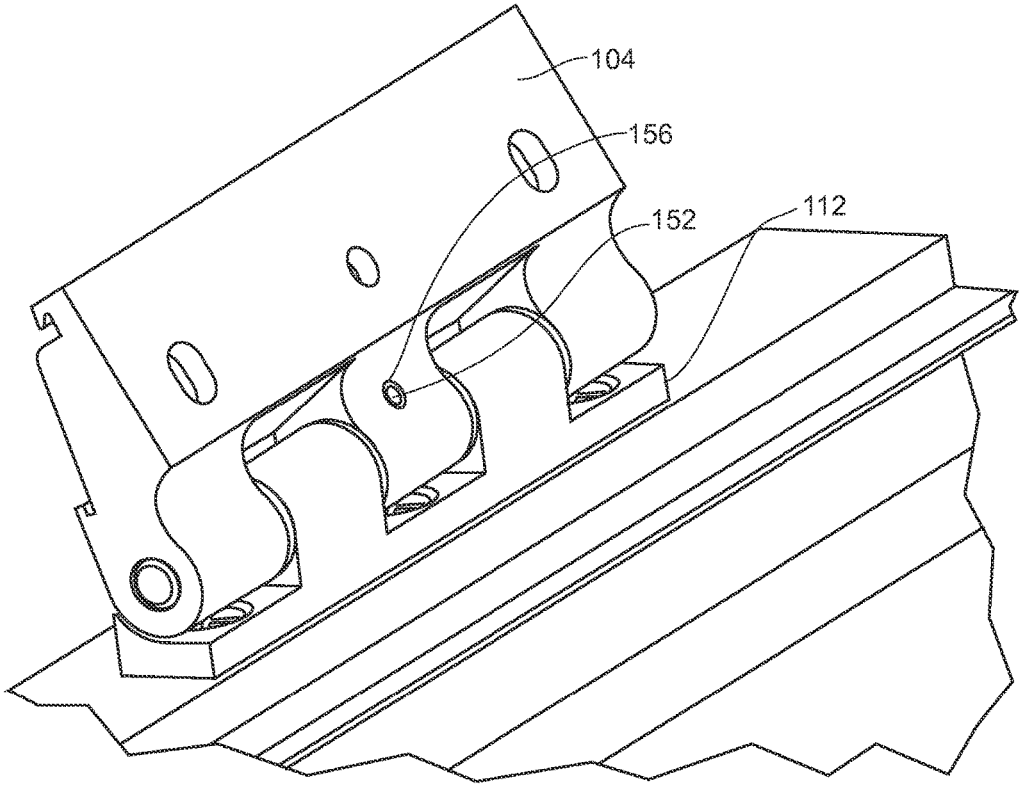
FIG. 13 is an isometric view of a self-sealing hinge including a set screw in accordance with an embodiment of the disclosure.
Figure 12:
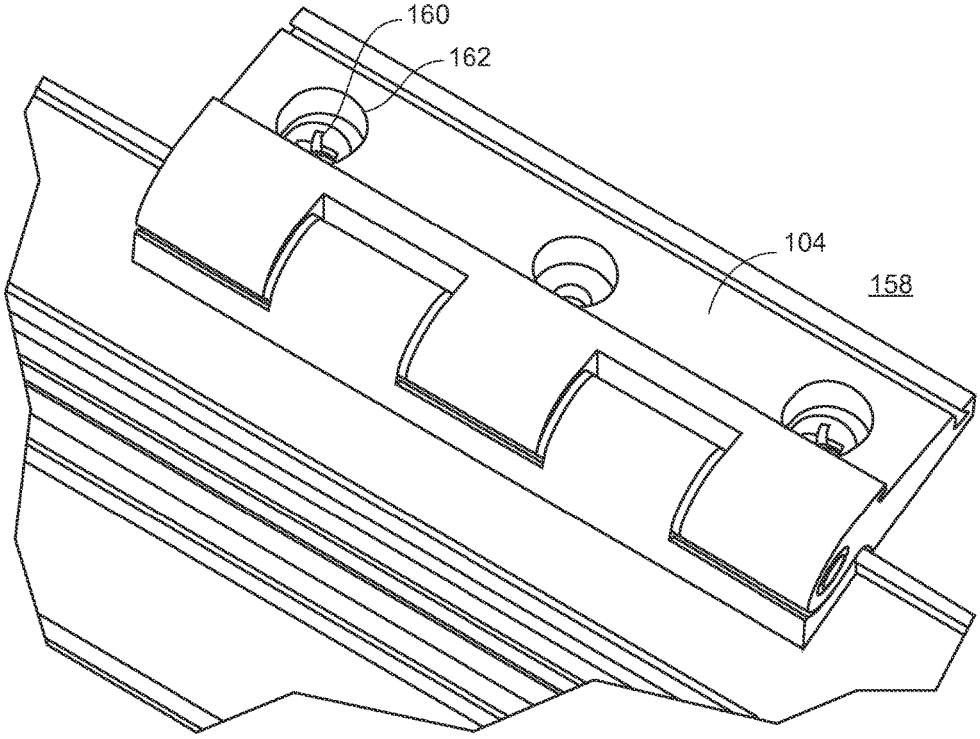

Referring to FIGS. 4 and 11-12, at step S6 hinge pin 128 is inserted into the sash leaf bore 148, the bushing bore 146, or the frame leaf bore 144, thereby pivotably coupling sash leaf 104 to frame leaf 112. Referring to FIGS. 1, 11, and 13, in one embodiment, to fix hinge pin 128 in place, or to prevent hinge pin 128 from sliding out of bores 144, 146 or 148, set screw 152 can inserted into notch 154 in hinge pin 128. In one embodiment, set screw 152 can be inserted through blind bore 156 defined in one of the knuckles 120 or 126.

Referring to FIGS. 4 and 14, at step S7, sash leaf 104 is mounted to sash 158. In one embodiment, sash leaf is fixedly coupled to sash 158 via one or more fasteners 160 passing through one or more apertures 162.

Figure 16:
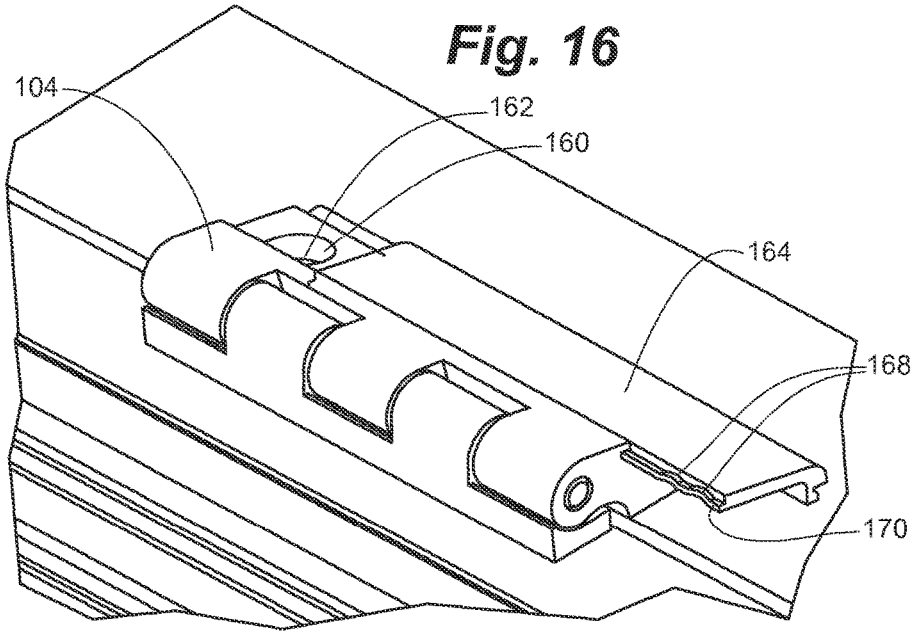

Referring to FIGS. 4 and 15-16, at step S8, cover plate 164 is mounted to sash leaf 104. In one embodiment, one or more rails 170 defined on cover plate 164 can slide into one or more tracks 166 defined in sash leaf 104. Cover plate 164 can be affixed in place via an adhesive or can be friction fit into track 166. In one embodiment, rail 170 includes one or more ribs 168, non-linear, or textured areas, to increase friction between cover plate 164 and sash leaf 104. In one embodiment, no cover plate 164 is required for complete assembly.

In one embodiment, a sealing member 114 can be employed on in conjunction with the sash leaf in addition to or in the alternative to employment in conjunction with the frame leaf.

Figure 17:
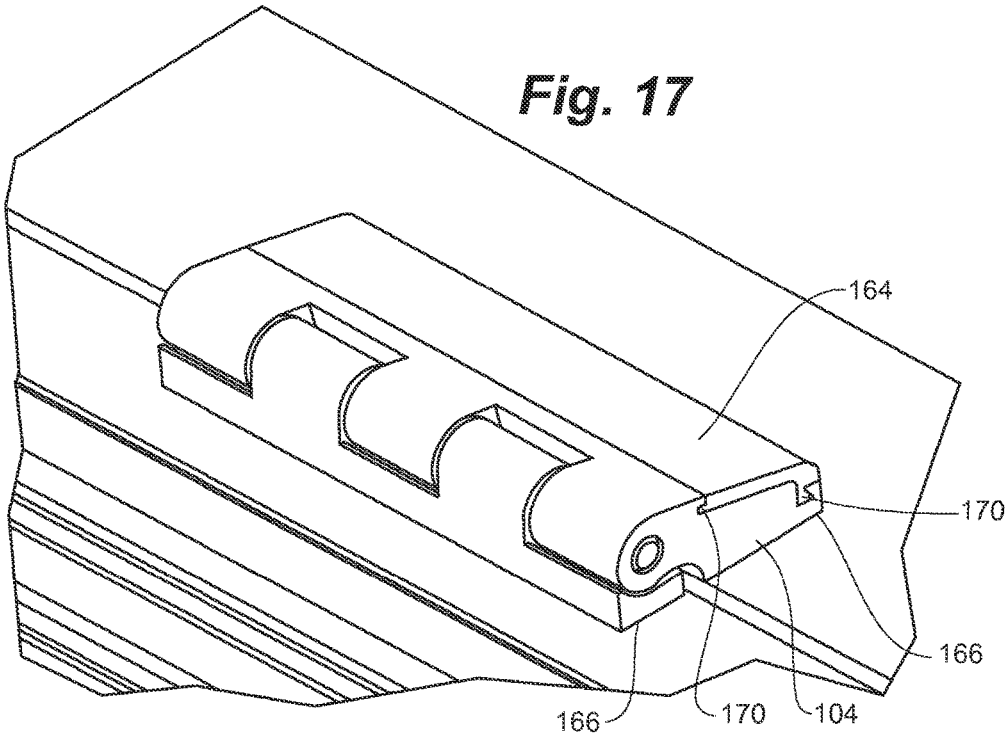
FIGS. 17-19 are isometric views of a window incorporating a self-sealing hinge in accordance with an embodiment of the disclosure.
Figure 17:
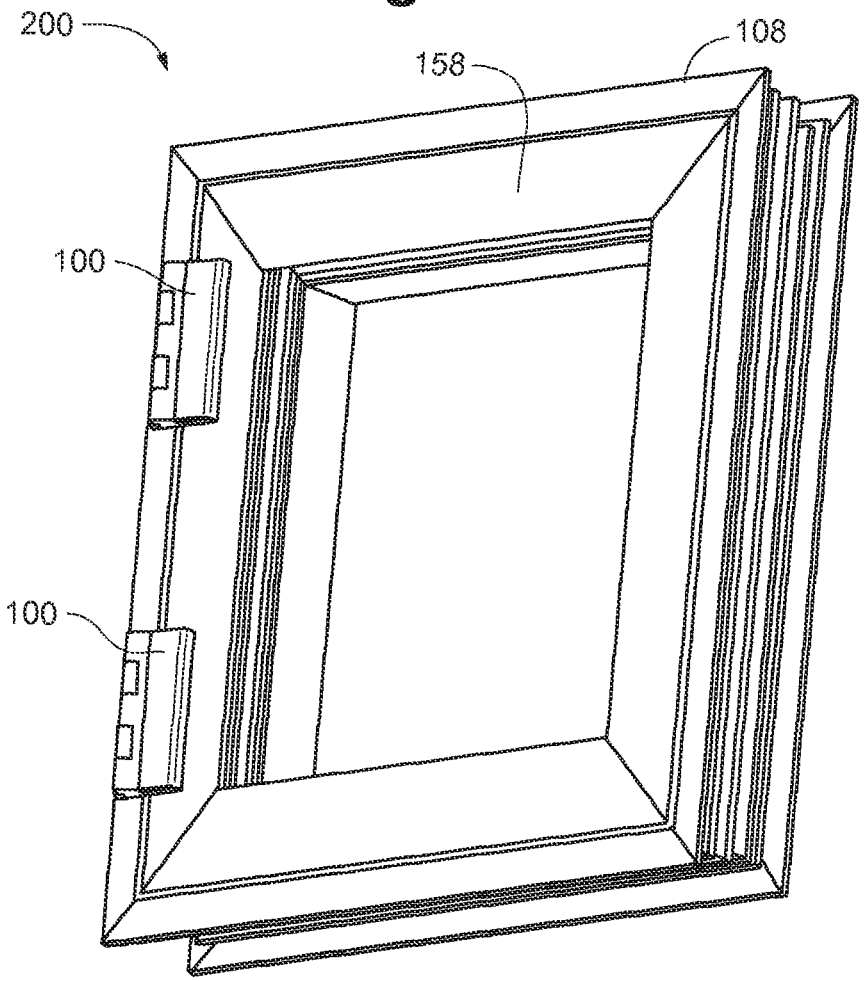
Figure 19:
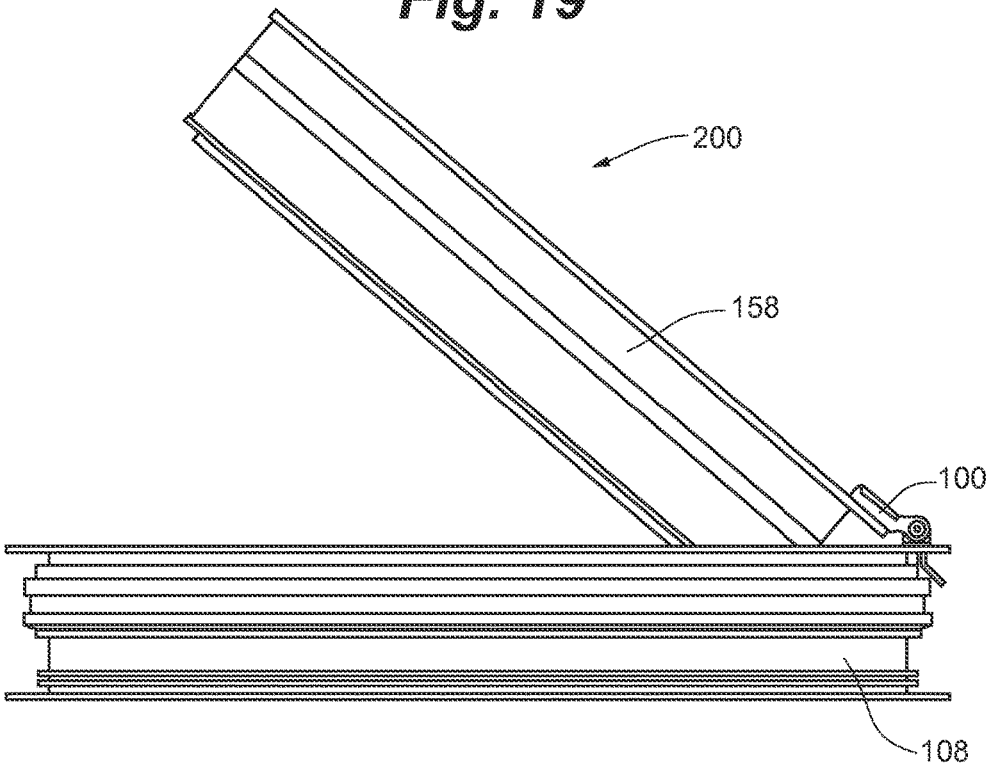

Referring to FIGS. 17-19, a window 200 including a plurality of self-sealing hinges 100 according to a disclosed embodiment is depicted. Window 200 can be configured to open vertically or horizontally.

Figure 20:
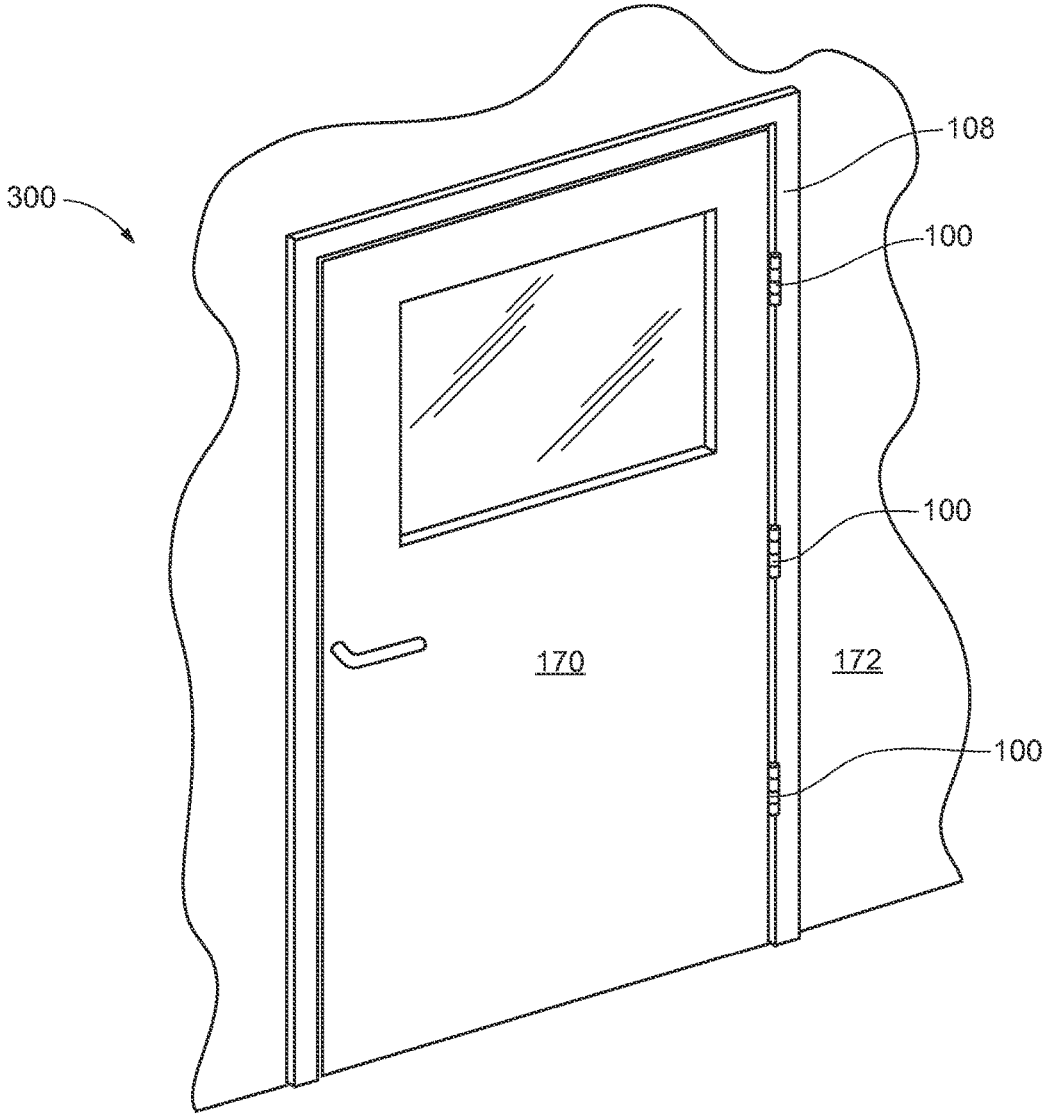
FIG. 20 is an isometric view of a door incorporating a self-sealing hinge in accordance with an embodiment of the disclosure.

Referring to FIG. 20, a door 300 including a plurality of self-sealing hinges 100 according to the above-disclosed embodiments is depicted. In one embodiment, door panel 170 is mounted to frame 180 via one or more self-sealing hinges 100. Frame 180 can be fixedly coupled to wall 172. In an embodiment including door panel 170, sash leaf 104 can alternatively be referred to as door panel leaf 104 or door leaf 104. The overall structure and function of the self-sealing hinges 100 used in conjunction with a door panel can be the same as otherwise described in this disclosure.

Embodiments of the disclosure are discussed in detail above. In describing embodiments, specific terminology is employed for the sake of clarity. However, the present disclosure is not intended to be limited to the specific terminology so selected. A person skilled in the relevant art will recognize that other equivalent parts can be employed and other methods developed without parting from the spirit and scope of the disclosure.

For purposes of interpreting the claims for the present invention, it is expressly intended that the provisions of 35 U.S.C. §112(f) are not to be invoked unless the specific terms "means for" or "step for" are recited in the subject claim.

What is claimed is:

1. A hinge for coupling a movable element to a frame, the frame defining an opening that receives the movable element, the hinge comprising:

a frame interface assembly adapted to attach to the frame at one or more attachment points, the frame interface assembly comprising a first leaf and a sealing member, the first leaf defining a mounting face adapted to abut an exterior surface of the frame and a plurality of spaced apart knuckles, the sealing member defining an attachment point liquid barrier sealing face adapted to abut an interior surface of the frame opposite the mounting face such that the hinge is self-sealing;

a second leaf adapted to attach to the movable element, the second leaf defining one or more knuckles; and a pin assembly including a hinge pin extending through the spaced apart knuckles of the first leaf and the one or more knuckles of the second leaf to operably couple the first leaf and the second leaf.

2. The hinge of claim 1, wherein the sealing member is made from metal.

3. The hinge of claim 1, wherein the sealing member is made from a resilient material.

4. The hinge of claim 3, wherein the sealing member is made from plastic.

5. The hinge of claim 3, wherein the sealing member is made from rubber.

6. The hinge of claim 1, wherein the sealing member includes a gasket.

7. The hinge of claim 6, wherein the gasket is made from silicone or rubber material.

8. The hinge of claim 1, wherein the sealing member includes an installation tab.

9. The hinge of claim 8, wherein the installation tab is detachable from the sealing member.

10. A hinge for coupling a window sash to a window frame, the hinge comprising:

a frame interface assembly adapted to attach to the window frame at one or more attachment points, the frame interface assembly comprising a frame leaf and a sealing member, the frame leaf defining a mounting face adapted to abut an exterior surface of the window frame and a plurality of spaced apart knuckles, the sealing member defining an attachment point liquid barrier sealing face adapted to abut an interior of the window frame opposite the mounting face such that the hinge is self-sealing;

a sash leaf adapted to attach to the window sash, the sash leaf defining one or more knuckles; and a pin assembly including a hinge pin extending through the spaced apart knuckles of the frame leaf and the one or more knuckles of the sash leaf to operably couple the frame leaf and the sash leaf.

11. The hinge of claim 10, wherein the sealing member is made from metal.

12. The hinge of claim 10, wherein the sealing member is made from a resilient material.

13. The hinge of claim 10, wherein the sealing member includes a gasket.

14. The hinge of claim 13, wherein the gasket is made from silicone or rubber material.

15. The hinge of claim 10, wherein the sealing member includes an installation tab.

16. The hinge of claim 15, wherein the installation tab is detachable from the sealing member.

17. A hinge for coupling a door panel to a door frame, the hinge comprising:

a frame interface assembly adapted to attach to the door frame at one or more attachment points, the frame interface assembly comprising a frame leaf and a sealing member, the frame leaf defining a mounting face adapted to abut an exterior surface of the door frame and a plurality of spaced apart knuckles, the sealing member defining an attachment point liquid barrier sealing face adapted to abut an interior of the door frame opposite the mounting face such that the hinge is self-sealing;

a door panel leaf adapted to attach to the door panel, the door panel leaf defining one or more knuckles; and a pin assembly including a hinge pin extending through the spaced apart knuckles of the frame leaf and the one or more knuckles of the door panel leaf to operably couple the frame leaf and the door panel leaf.

18. The hinge of claim 17, wherein the sealing member is made from metal.

19. The hinge of claim 17, wherein the sealing member is made from a resilient material.

20. The hinge of claim 17, wherein the sealing member includes a gasket.

21. The hinge of claim 17, wherein the gasket is made from silicone or rubber material.

22. The hinge of claim 17, wherein the sealing member includes an installation tab.

23. The hinge of claim 22, wherein the installation tab is detachable from the sealing member.

* * * * *